US005743425A

United States Patent [19]

Ellis

[11] Patent Number: 5,743,425

[45] Date of Patent: Apr. 28, 1998

[54] PERMANENTLY ATTACHABLE BUCKET LID WITH AIRTIGHT SEAL

[76] Inventor: John N. Ellis, 2535 N. 52nd St., #13, Phoenix, Ariz. 85008

[21] Appl. No.: 378,833

[22] Filed: Jan. 26, 1995

[51] Int. Cl.[6] ..... B65D 51/18

[52] U.S. Cl. ..... 220/254; 220/284; 220/360; 220/361; 220/367.1; 220/601; 220/763; 220/795; 220/796; 220/801; 220/802; 220/803; 220/804; 220/780; 220/789; 220/790

[58] Field of Search ..... 215/207, 228; 220/212.5, 601, 254, 260, 763, 761–762, 758, 281, 284, 308, 306, 318, 231, 320, 241, 242, 378, 354, 355, 360, 361, 356, 357, 352, 367.1, 203.11, 714, 715, 203.06, 319, 796, 801–804, 780–790, 795; 16/114 R; 222/570

[56] References Cited

U.S. PATENT DOCUMENTS

| | | | |
|---|---|---|---|
| 874,256 | 12/1907 | Sleight | 220/304 X |
| 1,436,021 | 11/1922 | Draper | 220/304 |
| 1,887,485 | 11/1932 | Behringer | 220/304 X |
| 2,962,185 | 11/1960 | Starr et al. | 220/254 |
| 3,025,997 | 3/1962 | Matusky et al. | 220/761 |
| 3,139,220 | 6/1964 | Darcy | 222/192 |
| 3,268,112 | 8/1966 | La Croce | 220/763 X |
| 3,401,827 | 9/1968 | Messina | 220/761 X |
| 3,635,380 | 1/1972 | Fitzgerald | 220/715 X |
| 3,672,547 | 6/1972 | Kozlowski | 222/567 |
| 3,850,341 | 11/1974 | Bart | 220/356 X |
| 4,000,839 | 1/1977 | Tecco et al. | 222/540 |
| 4,164,304 | 8/1979 | Roberson | 220/304 X |
| 4,201,306 | 5/1980 | Dubois et al. | 220/319 X |
| 4,288,000 | 9/1981 | Luker et al. | 220/281 |
| 4,335,827 | 6/1982 | Knize et al. | 220/307 X |
| 4,344,546 | 8/1982 | Dry | 220/319 |
| 4,429,805 | 2/1984 | Letica | 220/307 X |
| 4,474,305 | 10/1984 | Marco | 220/307 |
| 4,682,688 | 7/1987 | Budert | 16/114 R X |
| 4,779,754 | 10/1988 | Ten Eyck et al. | 220/66 |
| 4,787,530 | 11/1988 | Edwards | 220/307 X |
| 4,893,723 | 1/1990 | Seabolt | 220/695 X |
| 4,899,885 | 2/1990 | Van Koert | 220/23.83 X |
| 4,911,295 | 3/1990 | Venegoni | 220/23.83 X |
| 5,143,219 | 9/1992 | Yates, Jr. | 220/306 X |
| 5,170,533 | 12/1992 | Barry | 16/114 R |
| 5,193,244 | 3/1993 | Meyers | 16/114 R X |
| 5,207,345 | 5/1993 | Stewart et al. | 220/254 |
| 5,370,232 | 12/1994 | Tiramani | 220/761 X |
| 5,505,331 | 4/1996 | Rathbun | 220/763 X |

FOREIGN PATENT DOCUMENTS 70069 10/1949 Denmark .

*Primary Examiner*—Allan N. Shoap
*Assistant Examiner*—Robin A. Hylton
*Attorney, Agent, or Firm*—Snell & Wilmer, L.L.P.

[57] ABSTRACT

A child resistant lid is disclosed for use in conjunction with the standard build bucket for containment of materials. There is provided a threaded capped access opening of sufficiently small dimension to prevent the passage of a child's head, yet of sufficiently great dimension to allow for access to the material contained within the bucket. In addition, there is provided a handle grasp member and tool grip to aid the user in opening the threaded capped access opening. When it is desired by the user to pour the material directly from the bucket, there is provided a pour spout formed on an outermost peripheral edge of the lid and an air inlet opening formed on the cap member. The lid member of the present invention has provided a permanent locking mechanism to aid the user in permanently attaching the lid member to the lipped edge found on buckets of the type to be used in conjunction with the lid and to further serve as a safety feature.

20 Claims, 5 Drawing Sheets

FIG. 14
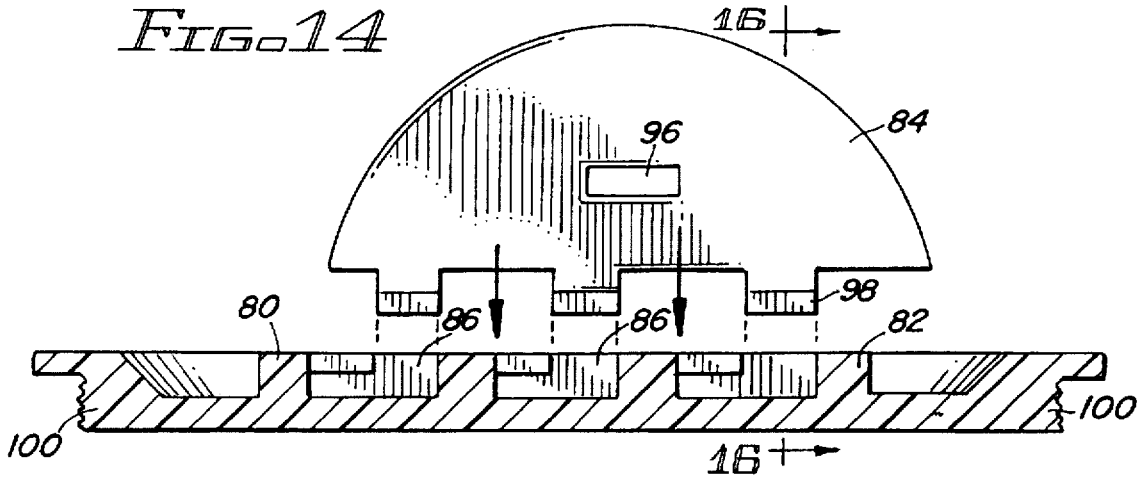
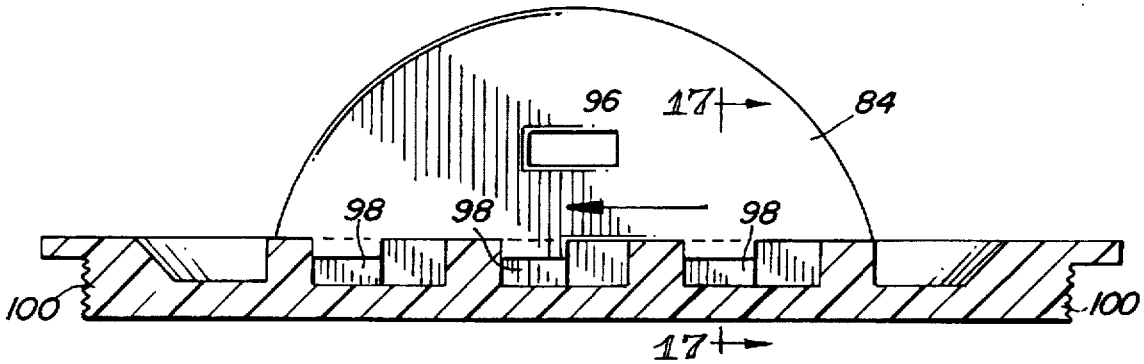
FIG. 15
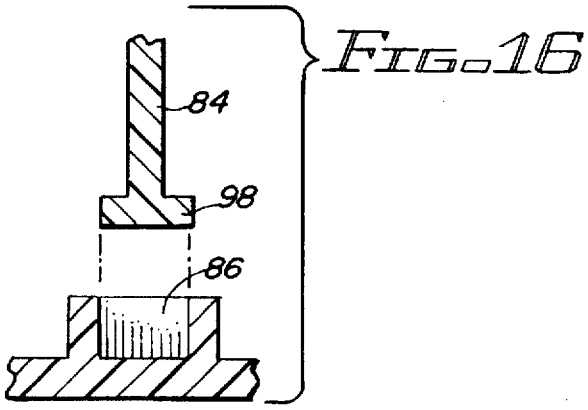
FIG. 16
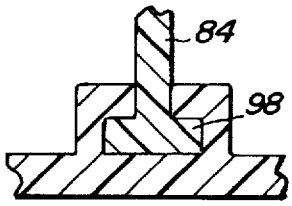
FIG. 17

PERMANENTLY ATTACHABLE BUCKET LID WITH AIRTIGHT SEAL

FIELD OF THE INVENTION

The present invention relates generally to lids for buckets generally found in the industrial field for the containment of paints, liquids, solvents, etc. More particularly, the present invention relates to a child resistant lid which is attached to a bucket by means of a permanent attachment. The lid has provided a wide-mouth dispensing opening, for access to the contents and interior of the bucket. This unique opening built into the surface of the permanently attached lid, remains small enough in diameter to prevent a child's head from passing through the opening and coming into contact with the contents of the bucket. This size restriction in the lid opening eliminates the chance of an accidental drowning of a small child in the material contained within the bucket.

BACKGROUND OF THE INVENTION

Many products are packaged and sold to the public in high density buckets made of polyethylene or polypropylene, having standard capacities of three and one-half, four or five gallons. Due to the sturdiness and accessibility of these buckets, the general public has a strong tendency to keep or save buckets of this type for secondary use in everyday household chores or for the storing of household products. Of present concern is the tendency for children to come into contact with buckets of this type having contained within liquids which could present a drowning hazard or harmful to the child if ingested.

It is a common occurrence for young children to have a high center of gravity and thus a tendency to topple over or fall into containers. As a result, several accidental drownings are reported each year throughout the United States, and other countries, of children who have accidently fallen into a bucket of sturdy construction and become trapped. Of current importance is the possible threat of drowning of small children in a liquid or particulate contained within the bucket. Of particular concern are the sturdy and heavy duty buckets, commonly made of polyethylene or polypropylene, which are normally sold to the general public for containment and packaging of paints, liquids, and swimming pool particulates, etc. As previously stated, children tend to have a high center of gravity and if they attempt to reach into a bucket of this nature, could lose their balance and fall head first into the bucket. With their center of gravity at that time towards the bottom of the bucket, combined with the sturdiness of the bucket and the weight of the material contained in the bucket, the child is unable to tip the bucket over and free himself.

Packages for chemicals and various liquid materials have most commonly been found in the form of sturdy polyethylene or polypropylene buckets of varying sizes. Accompanying these buckets are lids having formed about their exterior annular aspect, break away or removable portions allowing for the lid to be removed from the bucket by the consumer or user. This ability to remove the lid presents the problem of the lid being permanently separated from the bucket or the ability of a child to easily remove the lid. Many devices have sought to prevent this problem by permanently attaching the lid to the bucket, having formed through the surface of the lid an opening for access to the contents contained within the bucket.

For many years commercial buckets and lids have been available for commercial sales and general public use being sold as either a means for packaging a contained material or in the alternative sold solely for use by the consumer as a bucket. Included within the current patent literature are many buckets and lids which are capable of being sold in either form. Of particular importance are buckets and lids sold with the intent to prevent accidents which may occur through their sale and use.

U.S. Pat. No. 4,288,000 issued to Luker et al. discloses a child-resistant lid for a pail. As disclosed, a lid is provided having formed thereon a dispensing opening for discharge of the material contained therein. The lid and bucket together are comprised of a lip and cooperating edge member, which upon nesting, make it impossible to remove the lid from the bucket container. The lid has centrally provided a threaded capped opening for access to the interior of the bucket. The cap for the opening has provided a depending skirt member having a lug contained thereon. Upon attachment to the bucket, the lug engages into a cooperating stop thus preventing the lid from being removed by a child. To remove the cap, and thus gain access to the contents therein contained, the skirt portion of the cap must be squeezed inwardly to disengage the lug member from the stop and permit the cap to be unscrewed. This type of screw down engagement of the access cap prevents the opening of the cap by children of tender years due to their inability to inwardly squeeze the skirt member and thus disengage the lug member.

Disclosed in U.S. Pat. No. , 5,207,345, issued to Stewart, et al. is a lid adapter for a bucket having provided an airtight seal. As disclosed the device is comprised of an adapter member and a lid member. In use, the adapter is placed over the outside lipped edge of a bucket of standard type, thus engaging the lipped edge with a groove formed in the adapter member. Once engaged on the bucket, there is provided a easily removable threaded lid member, thereby providing an opening nearly as large as the opening of the container itself. In addition, there is provided a compressible seal located between the interior and exterior skirt members which comprise the adapter, to make the device airtight.

Finally, U.S. Pat. No. 4,000,839, issued to Tecco, et al. discloses a safety closure with removable lid for containers. As disclosed, the device is comprised of a child-resistant one-piece cap and one-piece lid assembly having therein formed an axially recessed center portion. The provided cap and lid assembly are preferably injection molded and comprised of polyethylene or polypropylene. In use, there is provided a tongue and groove system which aids in the retainment of the cap and lid members in frictional engagement, thereby securing the members and the contents contained in the container.

The current patent literature provides for various types of buckets and cooperating lids, yet fails to provide for a permanently attached lid having formed therein a locking device for permanent attachment to the outermost lipped edge of a bucket. In addition, disclosed is a threaded or frictionally engaged cap having integrally formed and attached thereto a handle grasp means. In use the handle grasp means is detached from the cap and positioned on or within a plurality of protruding locking members to aid in the twisting motion necessary for removal of the threaded cap or upward exertion of force necessary for the removal of a frictionally engaged cap. The cap provides for access to the interior of the bucket of sufficient size for necessary work, yet of a size of minimal dimension to prevent a child's head from passing therethrough. It is anticipated by this disclosure that the preferred access opening has a dimensional diameter between five and six inches, although slight dimensional difference is deemed anticipated herein. In addition, there is provided on the surface of the cap a tool grip to aid in removal of the cap in conjunction with a tool, such as a standard wrench. Formed into one side of the lid member is a pour spout to aid in the pouring of the contents from within the bucket. There is provided a cooperating air intake port located on the cap to aid in the outlet of the contents.

The child-protective bucket lid of the present invention is comprised preferably of injection molded polyethylene or polypropylene, or any suitable material as may be readily selected by those skilled in the art.

SUMMARY OF THE INVENTION

In accordance with the disclosed embodiments of the present invention, it is a principal objective of the present invention to provide a child protective bucket lid.

It is a more specific objective of the present invention to provide a child protective bucket lid capable of permanent attachment to buckets of varying sizes dependent upon the size of the lid provided for the associated bucket.

It is a more specific objective of the present invention to provide a child protective bucket lid having contained therein a threaded or frictionally engaged cap member to allow for access to the interior of the bucket.

It is a more specific objective of the present invention to provide a child protective bucket lid having formed thereon a detachable handle grasp member to aid in the twisting motion or upward exertion of force necessary for the removal of a threaded or frictionally engaged cap member.

It is a more specific objective of the present invention to provide a child protective bucket lid having formed therein a pour spout and an air inlet means for aid in pouring contents contained in the bucket.

It is a still further objective of the present invention to provide for a straight edge adjacent the access opening of the lid to enable the user to level or scrape away excess materials retrieved from the interior of the bucket.

These and other objects, features and advantages of the present invention will become more apparent to those skilled in the art from the following more detailed description of the non-limiting embodiments of the invention taken with reference to the accompanying Figures.

BRIEF DESCRIPTION OF THE DRAWINGS

Briefly summarized, a plurality of embodiments of the child protective bucket lid are described in conjunction with the illustrative disclosure thereof contained in the accompanying drawings in which:

FIG. 14 is a partial cross-sectional view showing in exploded side view the placement of the grasp member within the protruding locking members located on the surface of the lid.

FIG. 15 is a partial cross-sectional view of the second embodiment of the handle grasp member of the present invention, showing attachment within the recesses of the protruding locking member located on the surface of the lid.

FIG. 16 is a partial exploded cross-sectional view taken along line 16—16 of FIG. 14 showing the locking mechanism of the second embodiment of the handle grasp member of the present invention.

FIG. 17 is a partial cross-sectional view taken along line of 17—17 of FIG. 14, showing the locking mechanism of the second embodiment of the handle grasp member of the present invention in the locked position.

DETAILED DESCRIPTION OF THE PREFERRED EMBODIMENT

Figure 1:
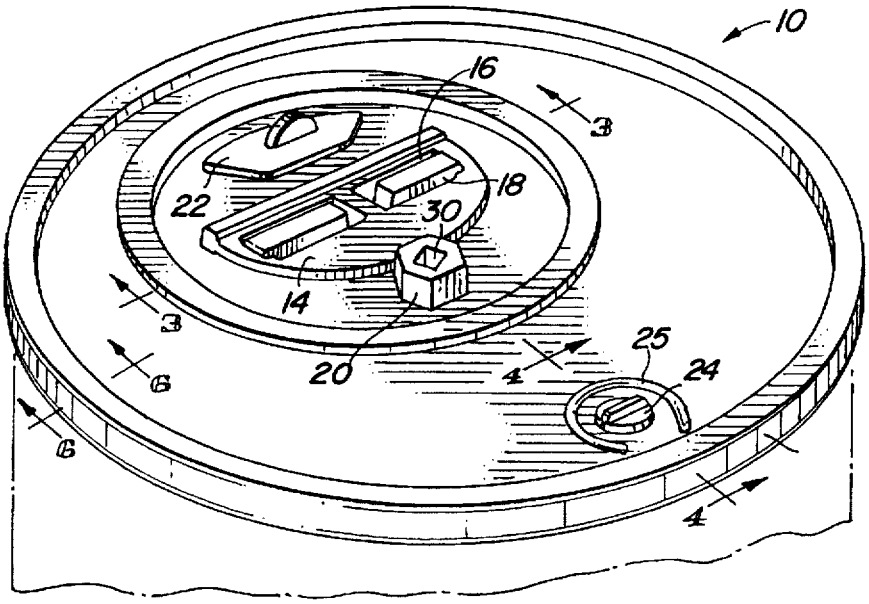
FIG. 1 is a perspective view of the first embodiment of the child protective bucket lid showing attachment to a bucket in phantom.

Referring particularly to the drawings, there is shown the elements of the present invention. In accordance with the first preferred embodiment of the bucket lid, and with particular reference to FIG. 1, there is provided bucket lid member 10 of the present invention shown in phantom with attachment to a bucket 11. Bucket lid 10 is of the same shape as the lipped edge of the bucket 11 to which the lid 10 is being attached. For example if the bucket 11 is round in shape, the peripheral edge of the bucket lid 10 will be round in shape. If the bucket is generally square in shape, the lid 10 will be of the same square in shape. The lid member 10 is generally of greater overall dimension than the associated bucket 11, thus enabling the lid 10 to drape over the lipped edge of the bucket 11, and having a plurality of depending skirt members positioned within the interior and exterior of the bucket 11. The depending skirt members provide a locking mechanism with the lipped edge of the bucket 11 and will be further described herein. The preferred embodiment of the bucket lid member 10 is comprised of a substantially round member having disposed about its outermost aspect, skirt members which form the permanent locking mechanism about the lipped edge of the associated bucket 11. Positioned, preferably offset the central axis of the lid member 10, is a threaded access opening 23 to allow the user to obtain materials contained within the interior of the bucket 11. Threaded cap member 12 is provided for closure of the threaded access opening 23 and for prevention of children of tender years gaining access to the materials contained within the bucket 11. It is anticipated by this disclosure that a frictional engagement of a non-threaded cap member may be made with an access opening having close tolerance dimension in lieu of the use of cooperating threads. The first embodiment of threaded cap member 12 is comprised of a handle grasp member 14, having defined therein a plurality of apertures 16. Located on the recessed surface of the threaded cap member 12 are a plurality of substantially rectangular protruding locking members 18 which serve in locking cooperation with the apertures 16 defined in the handle grasp member 14. In addition, these protruding locking members 18 serve to act as a locking mechanism for handle grasp member 14 when vertically positioned and aid in removing threaded cap member 12. In addition, apertures 16 serve as finger holes for the user once the user's hand is positioned on the handle grasp member 14. Threaded cap member 12 has positioned about its outermost annular aspect an overlapping peripheral edge 34 which serves to overlap the surface of the lid 10 when threaded cap member 12 is in its lockdown position. There is provided on the surface of threaded cap member 12 an air inlet opening (not shown) with plastic seal closure 22 to allow for air intake and ease in pouring of contents from the pour spout (not shown) formed on bucket lid member 10. It is anticipated that seal closure 22 may additionally be comprised of rubber or other suitable material.

As shown in FIG. 1, threaded cap member 12 has provided a tool grip 20, having a recessed portion 30 centrally defined therein for receipt of a ratchet type tool, to further aid in the removal of threaded cap member 12. Tool grip 20 is chamfered in exterior shape, thereby capable of receiving a force exerted by a standard wrench type tool to additionally aid in the removal of threaded cap member 12.

As previously indicated there is provided a pour spout opening (not shown) on the outermost aspect of lid member 10 having provided a plastic seal 24 for ease in pouring material contained within the bucket. It is anticipated that the seal 24 may also be comprised of rubber or any suitable material. There is provided about said pour spout opening a beading 25, thus forming a guide for containment and aid in pouring of the material contained within the bucket.

Figure 2:
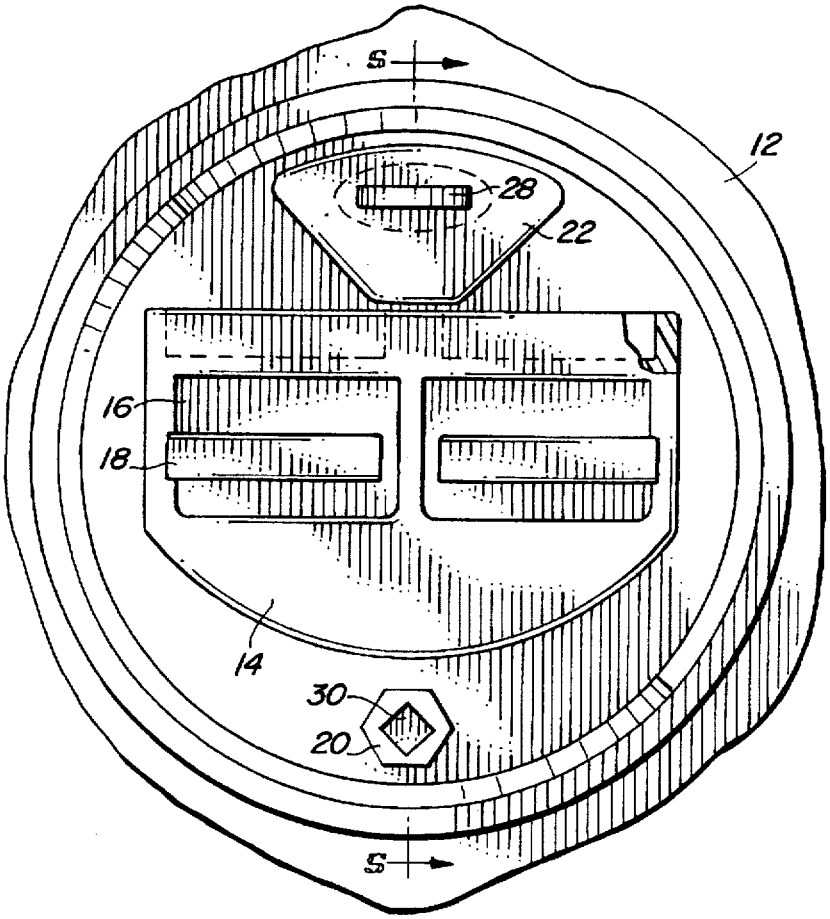
FIG. 2 is a partial top plan view of the cap member of the first embodiment of the present invention.

Referring now to FIG. 2, there is shown a partial top plan view of the first embodiment of the present invention, showing in detail the threaded cap member 12. As previously stated, threaded cap member 12 has positioned on its uppermost surface, handle grasp member 14, having formed therein a plurality of apertures 16 for receipt of protruding locking members 18. Protruding locking members 18, in conjunction with the apertures 16, formed in handle grasp member 14, lock the handle grasp member 14 down in its shipping position. Once received by the end user, the handle grasp member 14 is removed from the lockdown position, by the exertion of an upward force, and handle grasp member 14 is positioned in a vertical position on protruding locking members 18. A downward exertion of force upon the handle grasp member 14 then serves to lock the handle grasp member 14 in place. In addition, there is provided on the cap member 12, a tool grip 20, and an air inlet opening (not shown) having positioned therein an airtight plastic seal closure 22. Plastic seal closure 22 has formed on its uppermost surface a grasp member 28 to aid in the removal of the seal from the air inlet opening (not shown) at a time when air intake is desired.

Figure 3:
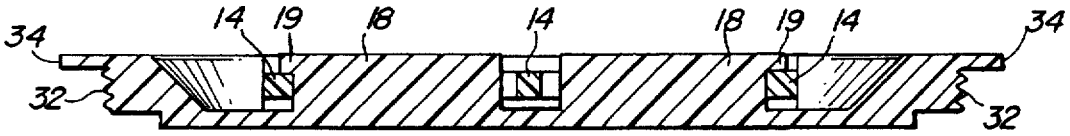
FIG. 3 is a partial cross-sectional view taken along line 3—3 of FIG. 1 showing the protruding locking member located on the cap member of the first embodiment.

Referring now to FIG. 3, there is shown in partial cross-sectional view taken along line 3—3 of FIG. 1, the protruding locking members 18 located on the cap member 12 of the first embodiment. As shown, cap member 12 has located about its outer annular edge, an overlapping edge portion 34 which serves to further seal the threaded cap member 12 against the bucket lid member 10. There is shown threads 32 located about the outermost depending peripheral edge of the cap member 12. Shown in cross-section are portions of the handle grasp member 14 positioned in its lockdown position against the uppermost surface of the cap member 12. Protruding members 18 each have located on their upper outermost aspects, a horizontal lip 19 which serves as the locking mechanism in that when handle grasp member 14 is positioned for lockdown against the uppermost side of protruding member 18 and a downward force is exerted, the handle grasp member 14 locks below the horizontal lip 19 of the protruding locking member 18.

Figure 4:
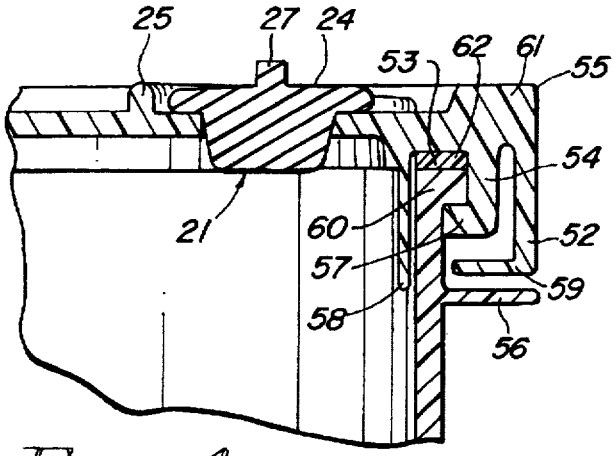
FIG. 4 is a partial cross-sectional view taken along line 4—4 of FIG. 4, showing the pour spout, rubber or plastic seal and locking mechanism of the lid of the present invention.

Referring now to FIG. 4, there is shown in partial cross-sectional view taken along line 4—4 of FIG. 4, the pour spout 21, plastic seal 24 and the formation of the locking mechanism of the lid 10 of the present invention. As shown the pour spout 21 formed into the surface of the lid member 10 is comprised of a substantially round aperture formed through the surface of the lid member 10. There is positioned a plastic seal 24 having formed thereon a grasp member 27 for airtight seal of pour spout 21. Provided about pour spout 21 is a raised beaded edge 25 which serves to channel the material being poured through the pour spout 21.

Figure 6:
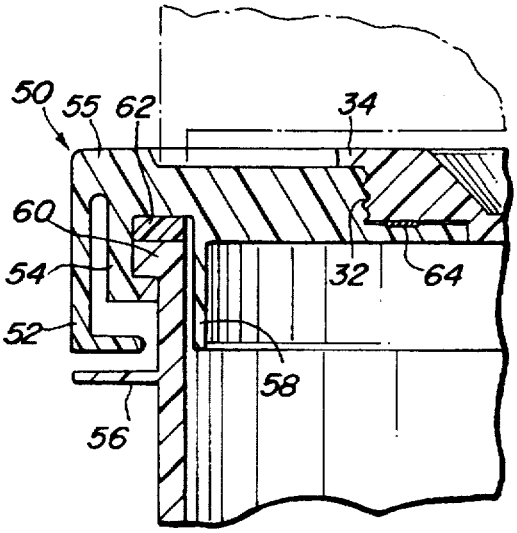
FIG. 6 is a partial cross-sectional view taken along line 6—6 of FIG. 1 showing the lid locking mechanism and the plurality of depending skirt members of the lid of the first and second embodiments of the present invention.

The permanent locking mechanism of the bucket lid member 10, as shown in FIG. 4 and FIG. 6, is comprised of a plurality of depending skirt members which serve to cooperate and lock with the existing lipped edge 60 of a bucket 11. Inner depending skirt member 58 is formed to allow positioning within the interior space of the bucket 11 once the lid is positioned on the lipped edge 60 of the bucket 11. First outer depending skirt member 54 is formed in a substantially "L" shape form, having formed at its distal end an inturned portion 57, thus capable of cooperating with the lipped edge 60 of the bucket. This inturned portion 57 serves to permanently attach the lid member 10 to the bucket by forcing the outer depending skirt 54 and the lipped edge 60 of the bucket together in a reversed "L" locked formation. This locking of the lid member 10 on the lipped edge 60 of the bucket 11 is further achieved by the deflecting property inherent in the composition of the overall bucket and specifically with regard to outer skirt member 54. There is formed a recess 53 where the inner depending skirt member 58 and the first outer depending skirt member 54 are joined. Positioned within this recess 53 is a compressible seal 62 to further make airtight the connection between the lid 10 and the lipped edge 60 of bucket 11. Second outer depending skirt member 52 is formed in a substantially "L" shaped form, having formed at its distal end an inturned portion 59 of greater dimensions than first outer skirt member 54, and in combination with horizontally protruding guard 56, serves to prevent the removal of lid member 10 in that the user is unable to reach, and thus release, first outer skirt member 54 from its locked position. In addition, there is formed a crown 55 where second outer depending skirt member 52 and first outer depending skirt member 54 connect. Crown 55 serves to further form an abutment for the positioning of an additional bucket when in stacked formation.

Figure 5:
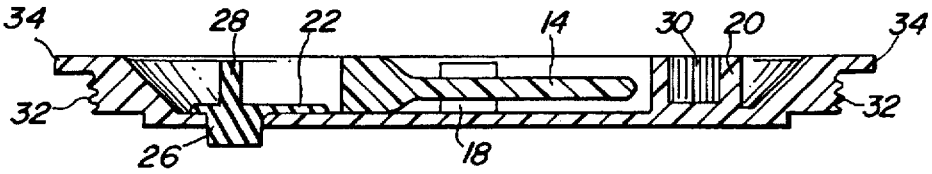
FIG. 5 is a partial cross-sectional view taken along line 5—5 of FIG. 2, showing the handle grasp member in its shipping position, located on the cap of the first embodiment of the present invention.

Referring now to FIG. 5, there is shown a partial cross-sectional view taken along line 5—5 of FIG. 2, depicting in its shipping position, the handle grasp member 14, located on the threaded cap member 12 of the first embodiment of the present invention. As shown, the handle grasp member 14 is positioned horizontal, and in parallel relation to the threaded cap member 12 and positioned in its centralmost aspect, thereby being located between the tool grasp member 20 and the plastic seal 22 of the air inlet opening 26. There is formed in the interior of the tool grasp member 20 a recessed portion 30 thereby capable of accommodating a rachet type tool for further aid in removal of the threaded cap member 12. It is further depicted that the interior surface of the cap member 12 is recessed at a level below that of the outer overlapping peripheral edge 34.

With reference to FIG. 6, there is shown a partial cross-sectional view taken along line 6—6 of FIG. 1 showing the lid locking mechanism and the plurality of depending skirt members of the lid 10 as disclosed in the first and second embodiments of the present invention. In addition, there is shown the threaded attachment of cap member 12 to lid member 10.

Figure 7:
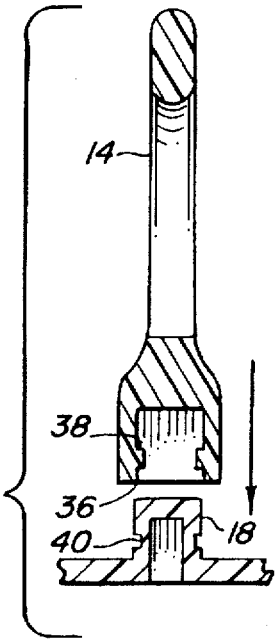
FIG. 7 is a partial exploded cross-sectional view of the handle grasp member of the present invention, showing attachment to the protruding locking members located on the surface of the cap.

With reference to FIG. 7, there is shown the handle grasp member 14 of the present invention having formed in its base, recessed area 36 for cooperating receipt of protruding locking members 18. In addition, there is formed a plurality of protruding locking members 38 located within the interior of area 36 which cooperatively lock with recessed channels 40 formed on protruding locking member 18.

Figure 8:
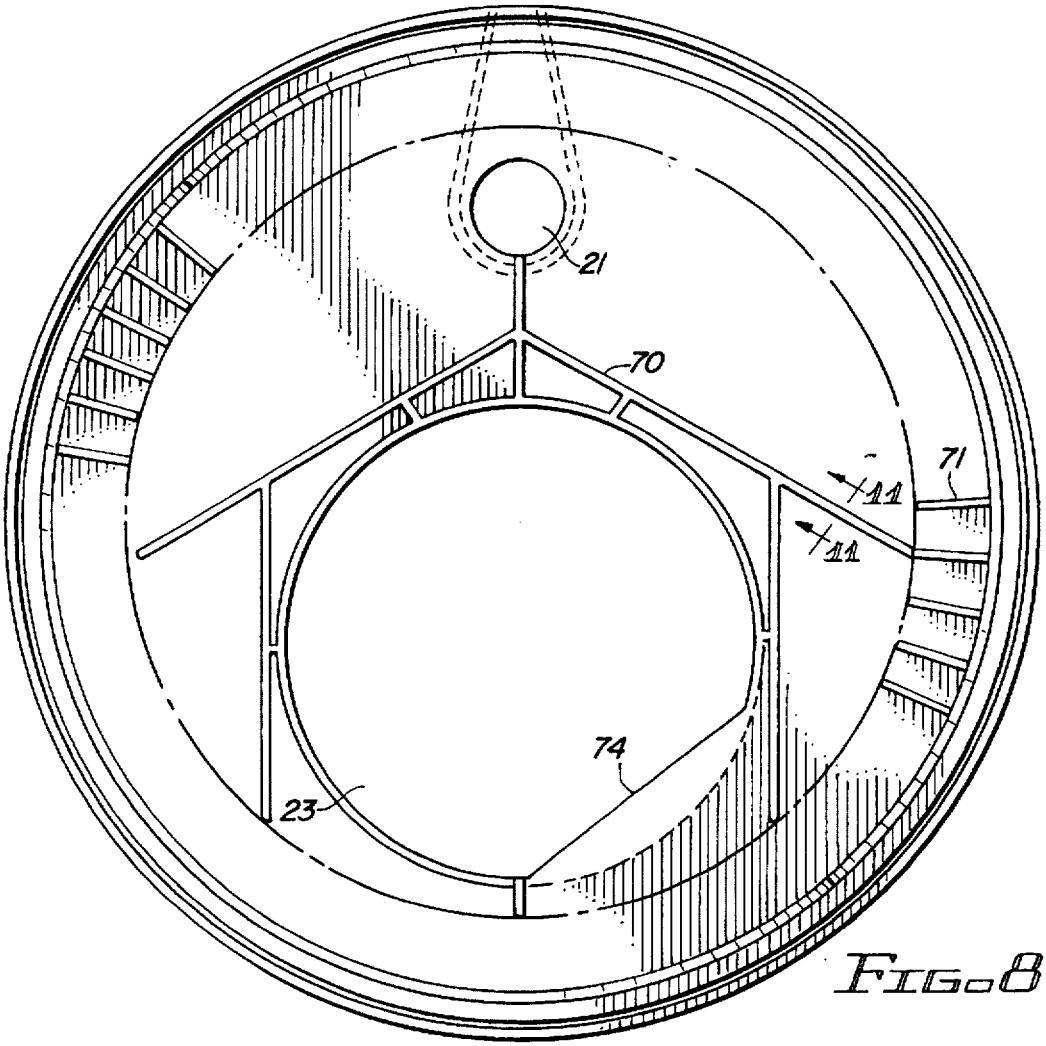
FIG. 8 is a bottom plan view of the child protective bucket lid of the present invention showing the formation of structural ribs, the pour spout, and cap access opening.
Figure 9:
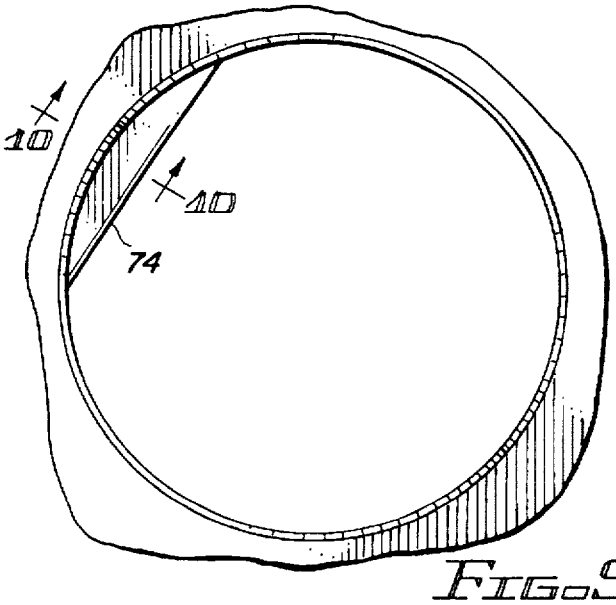
FIG. 9 is a partial bottom plan view of the access opening formed in the surface of the lid of the present invention, showing the straight edge paint scraper located along one aspect of the threaded opening.

FIGS. 8–11 show the underneath side of the bucket lid member 10 in bottom plan view, and cross-sectional view. In particular, shown in FIG. 8 is the child protective bucket lid 10 of the present invention showing the formation of structural ribs 70, the pour spout 21, and threaded access opening 23 formed in lid member 10. Rib members 70 are shown in preferred positioning, but it is understood that alternative variations of this rib positioning are anticipated by this disclosure. In addition, there is positioned about the exterior annular edge of the lid member 10, a plurality of vertically radiating rib members 71. There is shown in FIG. 8 and FIG. 9, formed on a lower plane of the threaded access opening 23, an extending straight edge 74, for use in scraping or leveling materials which are removed through the threaded access opening 23.

Figure 10:
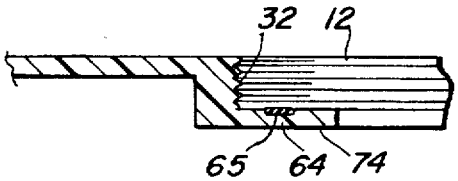
FIG. 10 is a cross-sectional view taken along line 10—10 of FIG. 9 of the present invention showing the cooperating threads of the cap member and the access opening and having formed thereunder the straight edge paint scraper.

With reference to FIG. 10, there is shown in detail, cross-sectional view taken along line 10—10 of FIG. 9 of the present invention showing the cooperating threads 32 of the cap member 12 and the threaded access opening 23 and having formed thereunder the straight edge paint scraper 74. There is shown to extend from the lowermost section of the threaded cap access opening 23, a protruding horizontal lip 64 having positioned therein a compressible rubber seal member 65 for airtight seal of the threaded cap member 12 in the threaded cap access opening 23. It is anticipated by this disclosure that seal member 65 may be comprised of rubber or any other suitable material.

Figure 11:
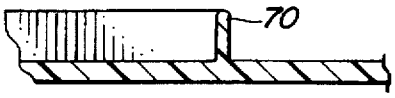
FIG. 11 is a cross-sectional view taken along line 11—11 of FIG. 8 of the present invention showing the protruding structural rib members.

Shown in further detail FIG. 11 are structural rib members 70. Rib members 70 protrude from the underneath surface of lid member 10 approximately ¼" to ½". Rib members 70 and 71 are preferably integrally formed from the same material as the lid member 10. Rib members 70 and 71 serve to further support lid member 10 when stored in a stacking manner.

Figure 12:
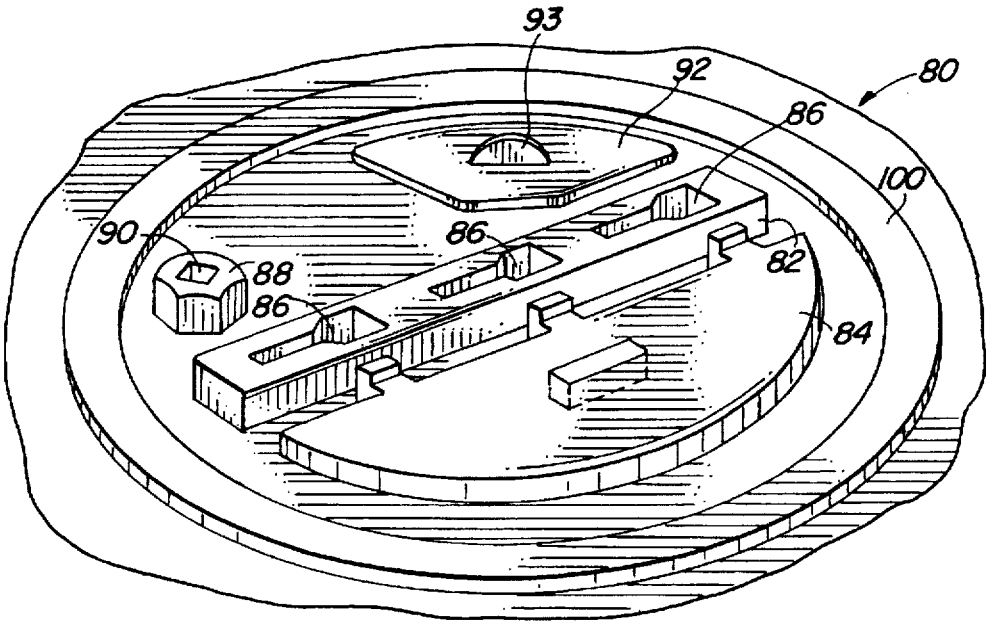
FIG. 12 is a partial top perspective view of the second embodiment of the cap member of the present invention showing the handle grasp member in its shipping position.

As previously disclosed, a second embodiment of a cap member is shown and depicted in FIGS. 12–17. In particular, there is shown in FIG. 12 a partial top perspective view of the cap member 80 of the second embodiment of the present invention showing the handle grasp member 84 in its shipping position. Cap member 80 is comprised of a handle grasp member 84, substantially rectangular protruding locking member 82, having formed therein a plurality of cooperating recessed openings 86, a tool grip 88 and air inlet aperture (not shown) having positioned to seal, a plastic seal member 92 having grasp member 93 formed thereon. It is anticipated that seal member 92 may alternatively be comprised of rubber or any other suitable material. As shown, cap member 80 of the second embodiment differs from the first embodiment in handle grasp member 84 configuration and use.

Figure 13:
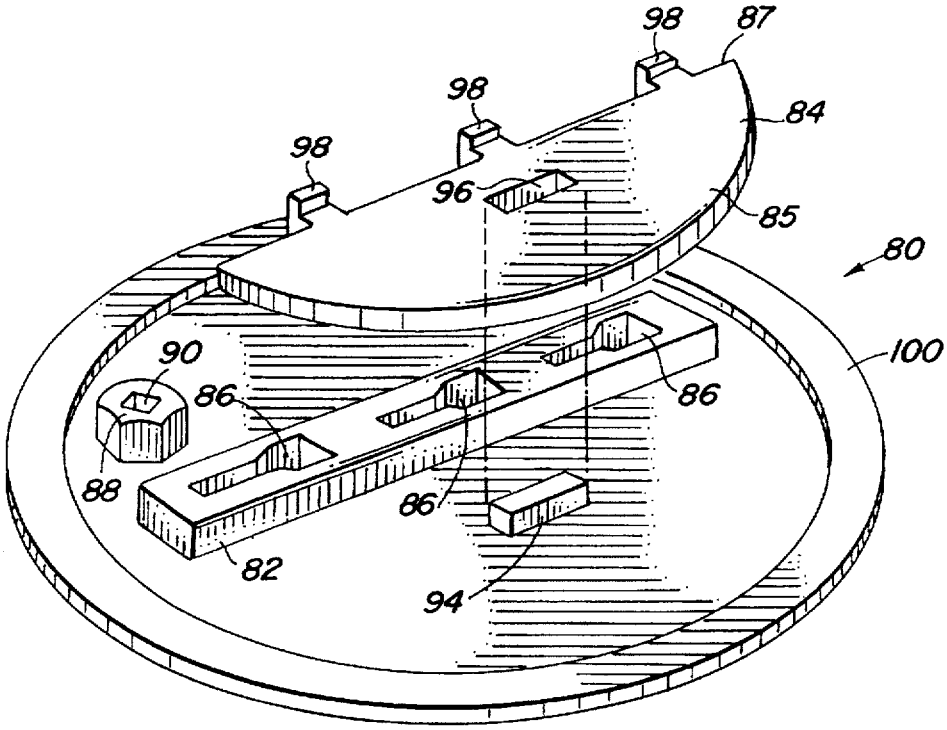
FIG. 13 is an exploded top perspective view of the second embodiment of the cap member of the present invention.

With reference to FIG. 13, there is shown an exploded top perspective view of the cap member 80 of the second embodiment of the present invention. Cap member 80 is comprised of a handle grasp member 84 formed having substantially one semi-circular portion 85 and one substantially straight edge 87, having formed on its distal end depending locking members 98. There is formed an aperture 96 in handle grasp member 84, being substantially rectangular in form, for cooperating locking relationship with protruding member 94, located on the upper surface of cap member 80. In addition, there is formed protruding from the surface of cap member 80, and centrally located, a substantially rectangular locking member 82 having formed therein recessed openings 86 for receipt of cooperating locking members 98 of the handle grasp member 84.

With reference to FIG. 14, there is shown in exploded partial cross-sectional side view, placement of the grasp member 84 within the formed recessed openings 86 of the substantially rectangular locking member 82 protruding from the surface of cap member 80. Shown is aperture 96 formed in the substantially planar aspect of handle grasp member 84 and depending protruding locking members 98. During shipment and storage, handle grasp member 84 is positioned in a lockdown position parallel to the recessed surface of cap member 80. To achieve lockdown position, aperture 96 of the handle grasp member 84 is coaligned with protruding member 94, having close tolerance dimensions with aperture 96, thereby capable of allowing handle grasp member 84 to be snapped onto protruding member 94 with a downward exerting force. In use, handle grasp member 84 is snapped off using an upwardly exerted force and vertically aligned with its depending locking members 98 in cooperative alignment with recessed openings 86 formed in locking member 82. Once vertically positioned, the handle grasp member 84 is lowered into the recessed openings 86, and as shown in FIG. 15, slideably locked into the recessed openings 86. This cooperating locking mechanism is further shown and depicted in FIGS. 16 and 17 in which protruding members 98 are shown to be substantially inverted "T" shaped and recessed openings 86 are cooperatively shaped.

It is anticipated by this disclosure that handle grasp member 14 of the first embodiment and handle grasp member 84 of the second embodiment are not load bearing in structural formation, and thereby not intended to support the weight of the bucket and contained material. The handle grasp members 14 and 84 are intended for use as a means for removing the threaded cap members 12 and 80 of the disclosed first and second embodiments. In addition, handle grasp members 14 and 84 are anticipated to be canted in an offset direction, thus preventing support of the bucket and contained material by the grasp members 14 and 84 when using the pour spout 21 to removeably pour materials from the bucket.

It will be apparent to those skilled in the art, that the foregoing detailed description of the preferred embodiment of the present invention is representative of a child resistant lid for a bucket within the scope and spirit of the present invention. Further, those skilled in the art will recognize that various changes and modifications may be made without departing from the true spirit and scope of the present invention. Those skilled in the art will recognize that the invention is not limited to the specifics as shown here, but is claimed in any form or modification falling within the scope of the appended claims. For that reason, the scope of the present invention is set forth in the following claims.

What is claimed is:

1. A device for providing an airtight seal for a bucket having a lipped edge rim and an opening, said device comprising:

a lid of substantially the same size as the opening of the bucket wherein said lid comprises a depending inner skirt member, a first outer skirt member, and a second outer skirt member, whereby a permanent attachment is formed between said lid and the bucket when the inner skirt member is positioned within the opening of the bucket and at least a portion of the first outer skirt member is positioned beneath the lip of the bucket;

a pour spout and cooperating plastic seal positioned on an outer periphery of said lid;

a threaded access opening formed through said lid of dimension to allow access to materials contained within the bucket, said threaded access opening having a straight edge paint scraper formed on a lower plane of a circumference of said access opening and projecting inwardly toward said opening; and a cap threadably attached to said access opening comprising a surfaced uppermost surface, a handle grasp member detachable from said cap, a tool grip secured to said recessed uppermost surface having a chamfered exterior shape and a central recessed portion for receiving a ratchet type tool, an air inlet opening, and a cooperating plastic seal capable of sealing said air inlet opening.

2. The device of claim 1, wherein said inner skirt member and said first outer skirt member in conjunction form a recess having a compressible seal positioned therein.

3. The device of claim 1, wherein said second outer skirt member is formed to prevent access to said first outer skirt member thereby permanently attaching said lid to the bucket.

4. The device of claim 3, wherein said permanent attachment of said lid to the bucket is comprised of an inturned distal portion of said first outer skirt member in cooperation with the lipped edge of the bucket.

5. The device of claim 1, wherein said second outer skirt member comprises a distal inturned portion which can be positioned above a horizontal guard protruding from a top side of said bucket, thereby permanently attaching the lid member to the bucket.

6. The device of claim 1, wherein said cap member further comprises a plurality of rectangular locking members protruding from said recessed uppermost surface, said plurality of rectangular locking members each having a protruding horizontal lip formed on an outermost edge of each member, respectively, for vertically locking said handle grasp member in place in relation to said cap member.

7. The device of claim 6, wherein said handle grasp member is comprised of a substantially planar member having formed therein a plurality of apertures and a plurality of recessed channels located in a distal end of said handle grasp member which correspond with said plurality of rectangular locking members.

8. The device of claim 7, wherein said handle grasp member is positioned for shipping on said recessed surface of said cap by locking said handle grasp member in place below said protruding horizontal lip of said locking members in a position substantially parallel to said recessed surface of said cap whereby said plurality of rectangular locking members project through said plurality of apertures, respectively.

9. The device of claim 8, wherein said handle grasp member is vertically positioned for removing said cap by locking said handle grasp member in place whereby said plurality of locking members are placed within said plurality of recessed channels formed in said handle grasp member.

10. The device of claim 1 further comprising at least one rectangular locking member protruding from said recessed uppermost surface of said cap, said rectangular locking member having formed therein a plurality of recessed openings for vertically locking said handle grasp member in place in relation to said cap member.

11. The device of claim 10, wherein said handle grasp member further comprises a planar surface defined by a semi-circular edge and a straight edge having a plurality of protuberances depending from said straight edge for vertically locking said handle grasp member in said plurality of recessed openings formed in said rectangular locking member wherein said handle grasp member also comprises at least one aperture formed in said planar surface.

12. A device for providing an airtight seal and permanently attached closure for a bucket having a lipped edge rim and a horizontally protruding guard located below said rim comprising:

a lid of substantially the same size as an opening of the bucket, said lid comprising a depending inner skirt member, a first outer skirt member having an inturned distal portion, and a second outer skirt member having formed an inturned distal portion, whereby said inner skirt member and said first outer skirt member in connection form a recess having a compressible seal positioned therein, and whereby a permanent attachment is formed between said lid and the bucket when the lipped edge rim of the bucket is in conjunction with the inturned distal portion of said first outer skirt member and the inturned distal portion of said second outer skirt member is in conjunction with the horizontally protruding guard from the bucket;

a pour spout and cooperating plastic seal positioned on an outer periphery of said lid and having positioned about the perimeter of said pour spout a raised beading to aid in channeling material poured from within the bucket;

an access opening formed through said lid of dimension sufficient to allow access to materials contained within the bucket, said access opening having a straight edge paint scraper formed on a lower plane of a circumference of said access opening and projecting inwardly toward said opening; and a cap having means for attachment to said access opening comprising a recessed uppermost surface, a plurality of substantially rectangular locking members protruding from said recessed uppermost surface, a handle grasp member having formed therein at least one aperture, a tool grip secured to said recessed uppermost surface having a chamfered exterior shape and a central recessed portion for receiving a ratchet type tool, an air inlet opening, and a cooperating plastic seal capable of sealing said air inlet opening.

13. The device of claim 12, wherein said substantially rectangular locking members protruding from said recessed uppermost surface further comprise a protruding horizontal lip formed on an outermost edge of each member.

14. The device of claim 12, wherein said handle grasp member has formed in a distal end a plurality of recessed openings for cooperative locking with said rectangular locking members.

15. The device of claim 12, wherein said handle grasp member is positioned for shipping on said recessed surface of said cap by locking said handle grasp member in place below said protruding horizontal lip of said locking members in a position substantially parallel to said recessed surface of said cap whereby at least one of said plurality of rectangular locking members projects through said at least one aperture.

16. The device of claim 12, wherein said handle grasp member is positioned for removing said cap by locking said handle grasp member in place whereby said plurality of locking members are placed within said plurality of recessed openings formed in said handle grasp member.

17. The device of claim 12, wherein said handle grasp member is comprised of a substantially semi-circular edge and a straight edge having depending from said straight edge a plurality of protuberances for vertically locking said handle grasp member in a plurality of recessed openings formed in said rectangular locking member.

18. The device of claim 12, wherein said access opening further comprises male threads formed about said opening.

19. The device of claim 18, wherein said cap having means for attachment to said access opening, further comprises female threads formed about its exterior edge in cooperative alignment with said male threads of said access opening.

20. The device of claim 12, wherein said cap having means for attachment to said access opening is of a size sufficient to allow for close tolerance frictional engagement within said access opening.

* * * * *